US005762242A

United States Patent [19]

Yost

[11] Patent Number: 5,762,242

[45] Date of Patent: Jun. 9, 1998

[54] SKI CARRYING SYSTEM

[76] Inventor: George P. Yost, 102 Oswegatchie Rd., Waterford, Conn. 06385

[21] Appl. No.: 728,443

[22] Filed: Oct. 10, 1996

[51] Int. Cl.[6] ..... A63C 11/02

[52] U.S. Cl. ..... 224/250; 224/258; 224/917

[58] Field of Search ..... 224/917, 915, 224/250, 257, 258; 280/814; 294/147

[56] References Cited

U.S. PATENT DOCUMENTS

| | | | |
|---|---|---|---|
| 2,394,782 | 2/1946 | Kalske . | |
| 3,342,388 | 9/1967 | Duckworth . | |
| 3,346,155 | 10/1967 | Oechsle . | |
| 3,486,672 | 12/1969 | Esopi . | |
| 3,947,927 | 4/1976 | Rosenthal . | |
| 3,960,302 | 6/1976 | Mazzoni, Jr. | 224/917 |
| 4,002,277 | 1/1977 | Westerholm . | |
| 4,114,838 | 9/1978 | Knauf | 224/917 |
| 4,120,437 | 10/1978 | Hara . | |
| 4,470,528 | 9/1984 | Dyess | 224/917 |
| 4,729,591 | 3/1988 | Scalise | 224/917 |

FOREIGN PATENT DOCUMENTS

| | | | |
|---|---|---|---|
| 7906337 | 2/1981 | Netherlands | 280/814 |

*Primary Examiner*—Renee S. Luebke
*Attorney, Agent, or Firm*—Albert W. Hilburger

[57] ABSTRACT

A system for carrying skis and ski poles either by hand or over the shoulder comprises an elongated strap assembly extending between fore and aft ski loops to freely receive the ends of a pair of skis in side-by-side relationship. An adjustment buckle interconnects first and second strap members and their associated fore and aft ski loops to selectively create a transport loop of reduced size for carrying the skis by hand or one of enlarged size for carrying the skis over the shoulder. Fore and aft loops may also be provided to receive a pair of ski poles. In one embodiment, the strap members extend away from the ski loops at locations adjacent the ring members and the strap members are threaded through the ring members to form the pole loops such that as the strap members are drawn in a direction away from the ring members, the size of the pole loops is reduced until the pole loops snugly engage the ski poles. In another, preferred, embodiment, the strap members extend away from the ski loops at locations spaced from the ring members and the strap members are threaded through the ring members to form the pole loops such that as the strap members are drawn in a direction away from the ring members, the size of both the pole loops and the ski loops is reduced until the pole loops snugly engage the ski poles and the ski loops snugly engage the skis.

6 Claims, 3 Drawing Sheets

FIG. 1.
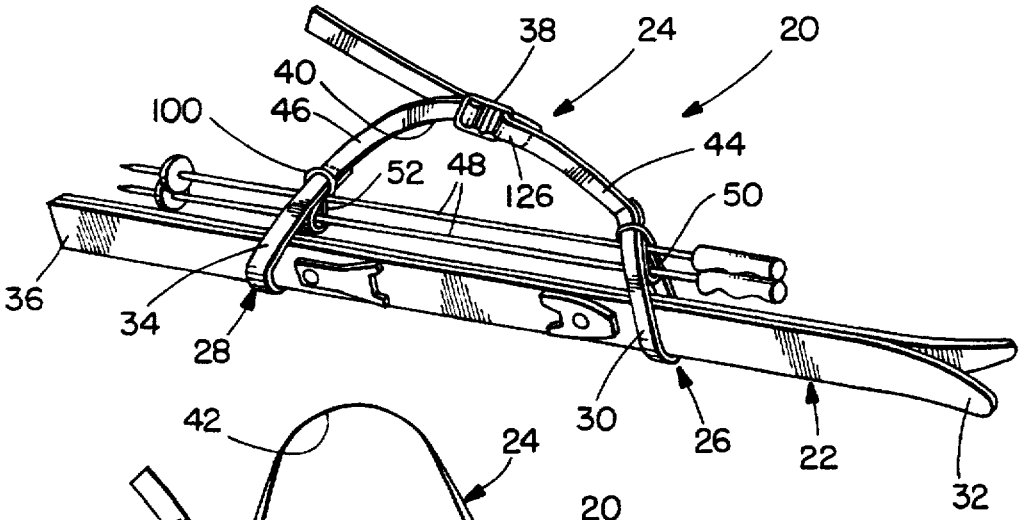
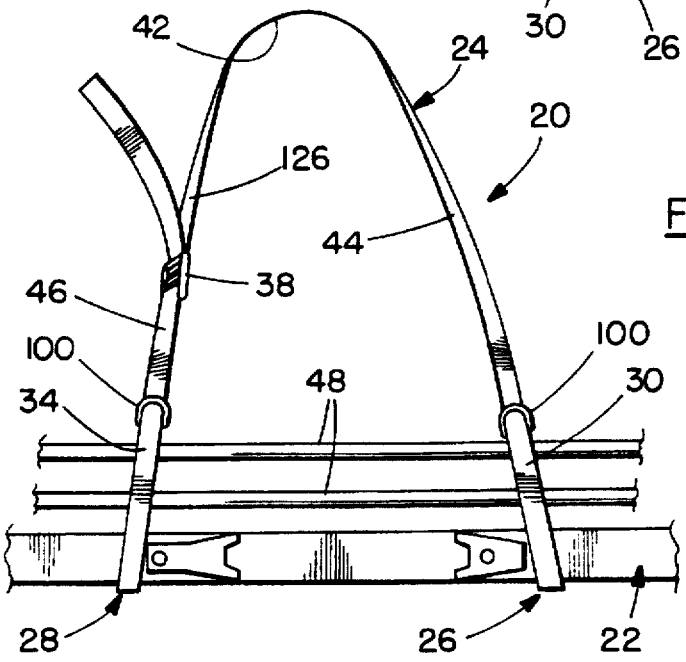
FIG. 2.
FIG. 3.
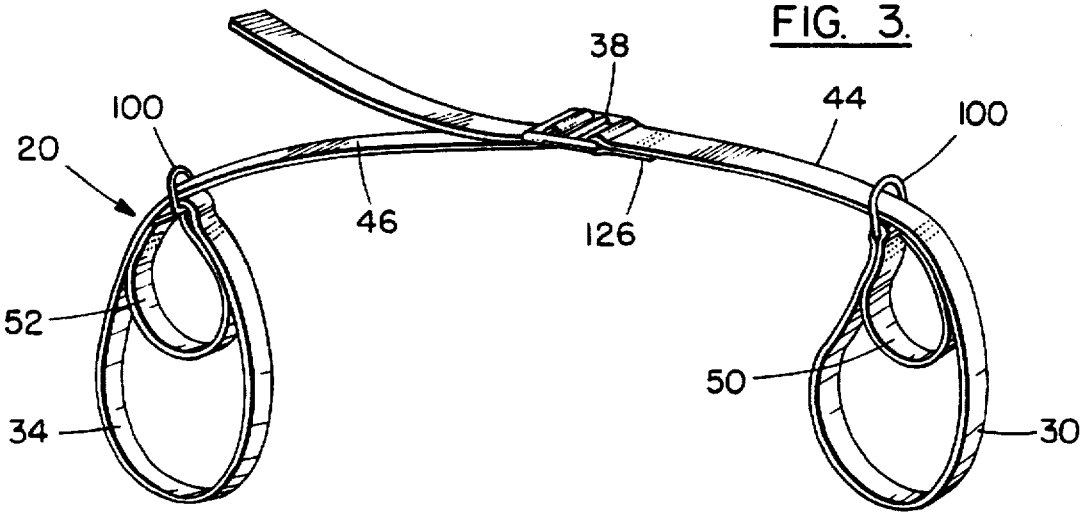

SKI CARRYING SYSTEM

BACKGROUND OF THE INVENTION

1. Field of the Invention

This invention relates generally to apparatus for carrying skis to and from a skiing area and, more particularly, to a lightweight, compact system for easily carrying skis and ski poles in a variety of orientations according to the preference of the skier.

2. Description of the Prior Art

One of the annoyances which detracts from the enjoyment of the sport of skiing is the difficulty of carrying the equipment required, such as a pair of skis, a pair of ski poles, a pair of ski boots, extra sweaters, and the like, from the parking lot or lodge to the ski area. As the popularity of skiing increases, this walk becomes more and more lengthy, and is a particular annoyance to women and children.

Skis and poles are awkward items to carry by hand, and many attempts have been made to provide a simple means for binding the items together so that they can be more easily carried.

Various types of mechanical devices have been developed to aid in the manual transport of the skis to the recreation site. Such devices often included a handle or shoulder strap coupled with some type of harness which wrapped around the skis or a bag was used which could fully or partially encase the skis. Although these devices aided in the manual transport of the skis, there remained substantial room for improvement.

The harness straps used to bind the skis, and fastening means attached thereto, of prior art type ski transport devices were often complex or difficult to engage and use, particularly in cold weather. The harness straps were often rigidly and permanently affixed to the carrying strap, the two straps often becoming twisted and entangled prior to use. The rigid manner in which some of these straps were attached also caused strain at the interface between the harness and carrying straps resulting in increased wear and premature failure. Also, in many instances, prior art devices would commonly necessarily be required to lie on the ground when the harness straps were being fastened, thereby collecting dirt, moisture, and other foreign material. This not only made the prior art ski transport devices sloppy and inconvenient to employ, but the collection of moisture, dirt, and the like on the straps would again increase the chances for premature failure of the straps and their components.

Additionally, the harness straps of prior art devices would not always securely hold or bind the skis, permitting the skis to slide while in the harness straps thereby causing discomfort to the skiing enthusiast while transporting the skis, and possibly causing scratching and denting of the ski surface.

A corresponding need existed for a portable, compact ski transport apparatus which could more effectively bind the skis during storage or transport. A further need existed for a ski transport apparatus which was more durable, would not readily entangle or otherwise be difficult to engage or use, and would provide a high level of performance over an increased life cycle.

Numerous examples of devices intended to ease the difficulties mentioned may be found in the prior art.

For example, a number of U.S. patents disclose slings having provision for securing skis and ski poles above the skis for carrying purposes. Typical of this grouping are No. 4,729,591 to Scalise, No. 4,002,277 to Westerholm, and No. 3,960,302 to Mazzoni, Jr.

In another instance, a number of U.S. patents disclose carriers using pairs of loops for carrying skis and ski poles in parallel but spaced relationship. Typical of this grouping are U.S. Pat. No. 4,588,115 to Uyeda, U.S. Pat. No. 4,120,437 to Hara, U.S. Pat. No. 3,947,927 to Rosenthal, U.S. Pat. No. 3,486,672 to Esopi, and U.S. Pat. No. 3,342,388 to Duckworth.

The following U.S. patents all disclose carriers of various types adapted to be supported either by shoulder or by hand: U.S. Pat. No. 4,470,528 to Dyess, U.S. Pat. No. 3,346,155 to Oechsle, and U.S. Pat. No. 2,394,782 to Kalske.

However, none of the devices presently available have achieved wide usage although the need for such a device is well known. The reasons why currently available ski and pole carrying apparatus are not generally used are apparently two-fold. One reason is that, in many instances, the known devices are difficult and time consuming to properly attach to the skis and poles, with the result that they cause more problems than they solve. Such devices employ buckles and like fastening means which are difficult to handle, particularly in cold temperatures when the skier is wearing heavy gloves. Furthermore, the baskets on the poles often interfere with the operation of the device. The second reason is that many of the prior art devices are bulky and have sharp metal components, so that they cannot be safely and conveniently stored in the skier's pocket while skiing. Since the purpose of the apparatus is to carry skis and poles to and from the slopes, it is essential that the apparatus be stored on the skier's person while skiing.

It was in light of the foregoing that the present invention was conceived and has now been reduced to practice.

SUMMARY OF THE INVENTION

The present invention relates to a system for carrying skis and ski poles either by hand or over the shoulder. It comprises an elongated strap assembly extending between fore and aft ski loops to freely receive the ends of a pair of skis in side-by-side relationship. An adjustment buckle interconnects first and second strap members and their associated fore and aft ski loops to selectively create a transport loop of reduced size for carrying the skis by hand or one of enlarged size for carrying the skis over the shoulder. Fore and aft loops may also be provided to receive a pair of ski poles. In one embodiment, the strap members extend away from the ski loops at locations adjacent the ring members and the strap members are threaded through the ring members to form the pole loops such that as the strap members are drawn in a direction away from the ring members, the size of the pole loops is reduced until the pole loops snugly engage the ski poles. In another, preferred, embodiment, the strap members extend away from the ski loops at locations spaced from the ring members and the strap members are threaded through the ring members to form the pole loops such that as the strap members are drawn in a direction away from the ring members, the size of both the pole loops and the ski loops is reduced until the pole loops snugly engage the ski poles and the ski loops snugly engage the skis.

The carrying system of the invention is made with belting material such as, but not limited to, polyester belting. There are two ends of the carrying system, each end having a loop. These two ends are drawn together in the center with a buckle which joins them together and allows for adjustment. As the loop is made there is an extra length of belting which comes up approximately six inches above where the loop is stitched or heat sealed. The top end of this extra belting is also stitched or heat sealed which forms the pole loops. Before inserting the skis into the strap assembly of the invention, the skis should be joined, bottom facing bottom. The first loop, on one end of the carrying system, is designed to slide over the tips of the skis. The other loop of the carrying system slides over the tails of the skis.

When the skis are held horizontally, the two loops slide inward and catch on the outer edges of the bindings. Then the ski poles are inserted into the upper loops made with the extra length of belting described above. The weight of the skis pull downward on the carrying system and makes a tight grip on the upper opening where the poles are inserted. This prevents the poles from sliding. Additional material may also be added inside the upper pole holder to apply added friction to hold the poles more securely. With the skis and poles thus supported by the carrying system, the skier then lifts up on the center of the belting which will make an arch in the belting. This arch is then placed over the shoulder of the skier and the skis and poles may be carried easily, securely and "hands free." Another way to carry the equipment is to pull the belting ends which extend through the center adjustment buckle. This will draw the two loop ends toward the center and will pull tightly against the outer edge of the bindings. The skis and poles can now be carried with the handle just created, in a manner similar to carrying a suit case. With the system of the invention, the skier carries all of his or her equipment onto the slope. When the destination is reached, the carrying system is removed from the skis, rolled up, and placed in a pocket, unlike other cumbersome carrying systems.

The ski carrying system of the invention is unique in that it allows a skier to carry his or her skis and poles in three different ways. The first way is over the shoulder, having the skis and poles hang horizontally at the side. The second way is to draw the strap up with the adjustable buckle and the skier may carry both skis and poles in one hand, as when carrying a suit case. The third way is to place the skis and poles in a vertical orientation behind the skier's shoulder with the tips of the skis pointing upward.

The ski carrier system of the invention is also unique by reason of its compact flexible design. A skier may carry the ski equipment right onto the ski slope, remove the skis and poles, roll up the carrier system and place it in a pocket. This saves the skier from having to enter the lodge to store the device as is often necessary with other bulky carrying systems. At the conclusion of the skiing session, it is only necessary to remove the carrying system from the pocket where it was earlier placed, place the skis and poles into the carrying system, and walk to the exit destination without struggling with equipment.

The system of the invention may be constructed with several types of loops on each end. In a first construction, twin fixed loops may be provided on each end of the strap assembly into which the skis and poles are respectively placed. In a second construction, a ring member is fixed to the strap member adjacent a fixed loop for the skis and the strap member is threaded through the ring member to form a pole loop. Then, the strap member is drawn in a direction away from the ring member which reduces the size of the pole loop until the pole loop snugly engages the pair of ski poles at their ends.

In a third construction, not unlike the second, a double ring member is provided adjacent a fixed loop for the skis and the strap member is threaded through the ring member, again to form a pole loop. Then, as in the second construction, the strap member is drawn in a direction away from the ring member which reduces the size of the pole loop until the pole loop snugly engages the pair of ski poles at their ends.

In both the second and third constructions, the weight of the skis and of the poles will close the pole loop.

The fourth, and preferred, construction is a twin lock loop, one fixed and one adjustable. In this instance, the strap members extend away from their associated ski loops at a location spaced from the ring members. By drawing each strap member in a direction away from its associated ring member, the size of the pole loop is reduced until the pole loop snugly engages the pair of ski poles and reduces the size of the ski loop until the ski loop snugly engages the skis. In this instance, even the fixed loop, the one that circumscribes the skis, tightens up when the weight of the equipment pulls down. This fourth construction holds both the skis and poles from sliding in the longitudinal direction and thereby enables a skier to carry the skis and poles on his or her back in the vertical orientation with the ski tips projecting upwardly.

Accordingly, a primary object of the present invention is to provide a system for easily carrying skis to and from a skiing area.

Another object of the present invention is to provide such a system which is lightweight and compact for easily carrying skis and ski poles in a variety of orientations according to the preference of the skier.

A further object of the present invention is to provide such a system which enables children to carry their own equipment.

Still another object of the invention is to provide such a system which can be easily applied to skis and ski poles even in inclement weather.

Yet a further object of the present invention is to provide such a system which can receive both skis and ski poles, either end first.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

BRIEF DESCRIPTION OF THE DRAWINGS

FIG. 1 is a perspective view of a carrier assembly embodying the invention for carrying a pair of skis and ski poles by hand in a horizontal orientation;

FIG. 2 is a perspective view of a carrier assembly embodying the invention for carrying a pair of the skis and ski poles in a horizontal orientation slung from the shoulder;

FIG. 3 is a perspective view of a preferred construction of the carrier assembly embodying the invention;

DETAILED DESCRIPTION OF THE PREFERRED EMBODIMENTS

Figure 4A:
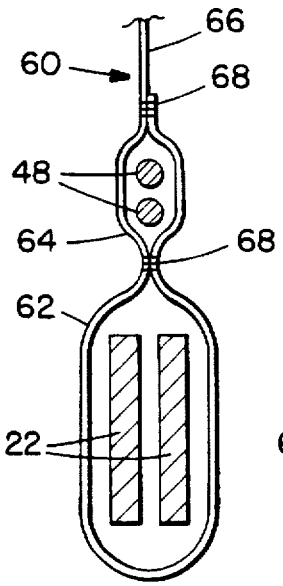
FIG. 4A is an end view of one component of the carrier assembly of the invention in the receiving mode, skis and ski poles received thereby being shown in section.

Turn now to the drawings and, initially, to FIGS. 1–3 which generally illustrates a carrier assembly 20 for carrying a pair of skis 22 alternatively by hand (FIG. 1) or over the shoulder of the skier (FIG. 2).

An elongated strap harness 24 extends between fore and aft ends, 26, 28, respectively, and has a fore ski loop 30 at the fore end 26 of a size to freely receive therethrough fore ends 32 of the skis 22 as they are placed in a side-by-side relationship. The strap harness 24 also has an aft ski loop 34 at the aft end 28 being of a size to freely receive therethrough aft ends 36 of the skis which continue to be in a side-by-side relationship.

A suitable buckle device 38 is located intermediate the fore and aft ends 26, 28 of the strap harness 24 for adjustably interconnecting the fore and aft ends such that, in one instance, the strap harness and the skis 22 together define a transport loop of reduced size 40 (FIG. 1) for the skier to carry the pair of skis by hand and, in another instance, the strap harness and the skis together define a transport loop of enlarged size 42 (FIG. 2) for the skier to carry the pair of skis over the shoulder of the skier.

The strap harness 24, which may be of a variety of suitable materials, such as canvas, polyester, or the like, and which may be woven, knitted, or otherwise formed, includes a first strap member 44 extending between the fore ski loop 30 and the buckle device 38 and a second strap member 46 extending between the aft ski loop 34 and the buckle device.

The carrier assembly 20 may be used to carry skis alone. However, since it is customary for a skier to also use ski poles 48, the carrier assembly is preferably designed with a fore pole loop 50 adjacent the fore ski loop 30 being of a size to freely receive therethrough the fore, or handle, ends of a pair of the ski poles in side-by-side relationship. In like fashion, the carrier assembly 20 also has an aft pole loop 52 adjacent the aft ski loop 34, again being of a size to freely receive therethrough the aft, or pointed, ends of the pair of ski poles.

Figure 4B:
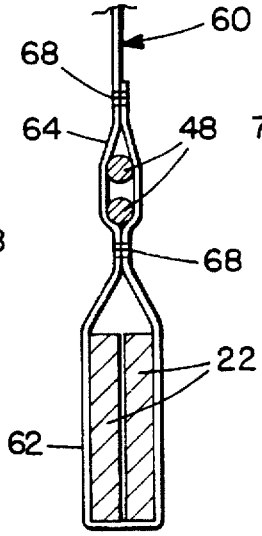
FIG. 4B is an end view of one component of the carrier assembly of the invention in the carrying mode, skis and ski poles received thereby being shown in section.

In one embodiment of the invention illustrated in FIGS. 4A and 4B, a strap harness 60 for the carrier assembly has ski loops 62 which are of a fixed size and adjacent pole loops 64 which are also of a fixed size. Each ski loop 62 and each pole loop 64 may be defined by stitching of the strap material 66 of which the strap harness is composed as at 68. It will be understood, however, that other techniques may be used in place of the stitching 68 to define the ski loops and the pole loops as, for example, staples, grommets, heat sealing, or the like.

As previously noted, the ski loops and the pole loops are of a size sufficient to receive and allow the skis and ski poles, respectively, to pass therethrough as illustrated in FIG. 4A. However, with the operation of gravity, as occurs when the skier carries the carrier assembly 20 in the manner illustrated in FIGS. 1 and 2, the strap material 66 of the ski loop 62 encloses around the skis 22 forcing them into abutting relationship and in similar fashion, the strap material of the ski pole loop 64 encloses around the ski poles 48 and holds them snugly. The frictional engagement of the strap material against the outer surfaces of the skis and of the ski poles is sufficient to prevent them from any substantial longitudinal movement relative to the carrier assembly 20 when held in the manner illustrated in either FIG. 1 or FIG. 2.

Figure 5A:
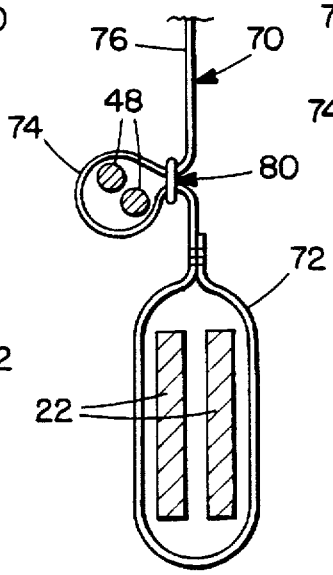
FIGS. 5A and 5B are end views, respectively, similar to FIGS. 4A and 4B and illustrating another embodiment of the invention.
Figure 5B:
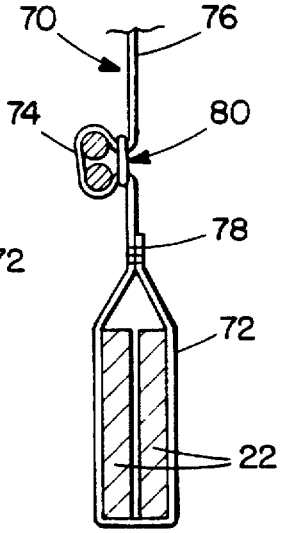
Figure 6:
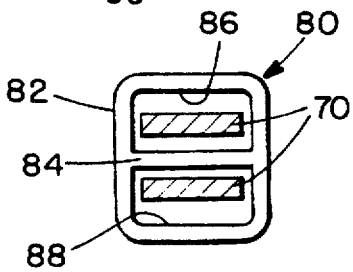
FIG. 6 is a plan view of a double ring member, a component of one embodiment of the invention.

In another embodiment of the invention illustrated in FIGS. 5A and 5B, a strap harness 70 for the carrier assembly has ski loops 72 which are of a fixed size and near by pole loops 74 which are size adjustable. Each ski loop 72 may be defined by stitching 78, or by use of other joining techniques. In this instance, a double ring member 80 (FIG. 6) is slidably engaged with the strap material 76 adjacent the ski loop. The double ring member 80 includes an endless peripheral band 82 and a cross member 84 joined to the peripheral band at spaced locations to thereby define first and second side-by-side but spaced apertures 86, 88 therein.

With this construction, the strap harness 70 has a strap member which extends away from the ski loop 72 toward the buckle device 38, the strap member being threaded through the first and second apertures 86, 88 and around the cross member 84 of the fore double ring member 80 to form the pole loop 74. By drawing on the strap members for both the fore and aft ski loops in a direction away from the double ring members, the size of each of the pole loops is reduced until the pole loops snugly engage the pair of ski poles which they encompass. Then, as with the embodiment of FIGS. 4A and 4B, with the operation of gravity, as occurs when the skier carries the carrier assembly 20 in the manner illustrated in FIGS. 1 and 2, the strap material 76 of the ski loop 72 encloses around the skis 22 forcing them into abutting relationship and, in similar fashion, the strap material of the ski pole loop 74 encloses around the ski poles 48 and holds them snugly, viewing FIG. 5B. Again, the frictional engagement of the strap material against the outer surfaces of the skis and of the ski poles is sufficient to prevent them from any substantial longitudinal movement relative to the carrier assembly 20 when held in the manner illustrated in either FIG. 1 or FIG. 2. Of course, it will be recognized that the frictional engagement of the loop 74 on the ski poles is tighter and therefore superior to that of the loop 64.

Figure 7A:
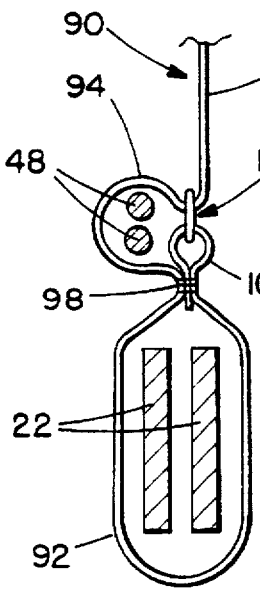
FIGS. 7A and 7B are end views, respectively, similar to FIGS. 4A and 4B and illustrating still another embodiment of the invention.
Figure 7B:
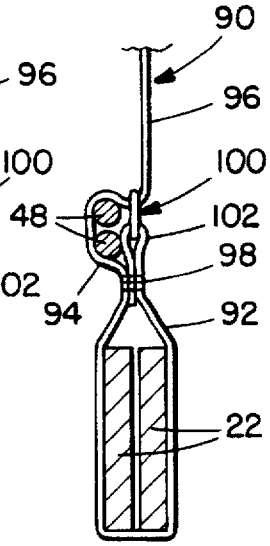
Figure 8:
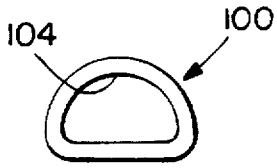
FIG. 8 is a plan view of a ring member, a component of other embodiments of the invention.

In still another embodiment of the invention illustrated in FIGS. 7A and 7B, a strap harness 90 for the carrier assembly has ski loops 92 which are of a fixed size and near-by pole loops 94 which are size adjustable. Each ski loop 92 may be defined by stitching 98 of the strap material 96, or by use of other joining techniques. In this instance, a ring member 100 (FIG. 8) is fixed to the strap material at a mini-loop 102 adjacent the ski loop and the pole loop. Also, the ring member 100 is slidably engaged with the strap material 96 adjacent the ski loop pole loop 94.

With this construction, the strap harness 90 has a strap member which extends away from the ski loop 92 and toward the buckle device 38, the strap member being threaded through an aperture 104 of the ring member 100 to form the pole loop 94. By drawing on the strap members for both the fore and aft ski loops in a direction away from the ring members, the size of each of the pole loops is reduced until the pole loops snugly engage the pair of ski poles which they encompass. Then, as with the embodiment of FIGS. 4A, 4B, and 5A, 5B, with the operation of gravity, as occurs when the skier carries the carrier assembly 20 in the manner illustrated in FIGS. 1 and 2, the strap material 96 of the ski loop 92 encloses around the skis 22 forcing them into abutting relationship and, in similar fashion, the strap material of the ski pole loop 94 encloses around the ski poles 48 and holds them snugly, viewing FIG. 7B. Again, the frictional engagement of the strap material against the outer surfaces of the skis and of the ski poles is sufficient to prevent them from any substantial longitudinal movement relative to the carrier assembly 20 when held in the manner illustrated in either FIG. 1 or FIG. 2. Of course, it will be recognized that the frictional engagement of the loop 94 on the ski poles is tighter and therefore superior to that of the loop 64.

Figure 9A:
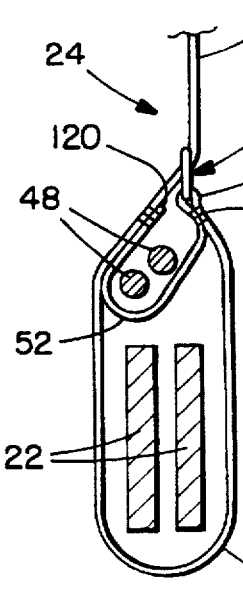
FIGS. 9A and 9B are end views, respectively, similar to FIGS. 4A and 4B and illustrating yet another, and preferred, embodiment of the invention.
Figure 9B:
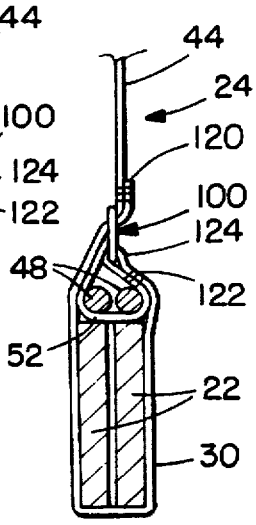

In yet another embodiment of the invention illustrated in FIGS. 9A and 9B, the strap harness 24 for the carrier assembly has ski loops 30 which are of a fixed maximum size when the strap material of which they are comprised is drawn taut. The near-by pole loops 52 are size adjustable. In this instance, the strap harness 24 includes the fore strap member 44 extending between the buckle device 38 (FIGS. 1 and 2) and a fore extreme end 120. Portions of the fore strap member are joined, as by stitching 122, at spaced locations distant from the fore extreme end 120 to form a fore mini-loop 124. A fore ring member 100 is slidably fixed to the mini-loop 124. The fore strap member 44 has a free end 126 (see FIGS. 1, 2, and 3) threaded through the fore ring member 100 and attached to the buckle device 38.

With this construction, when the free end 126 of the fore strap-member 44 is drawn in a direction away from the fore ring member 100, the size of the fore pole loop 52 is reduced until the fore pole loop snugly engages the pair of ski poles at their fore ends and reduces the size of the fore ski loop until the fore ski loop snugly engages the pair of skis at their fore ends.

Figure 10:
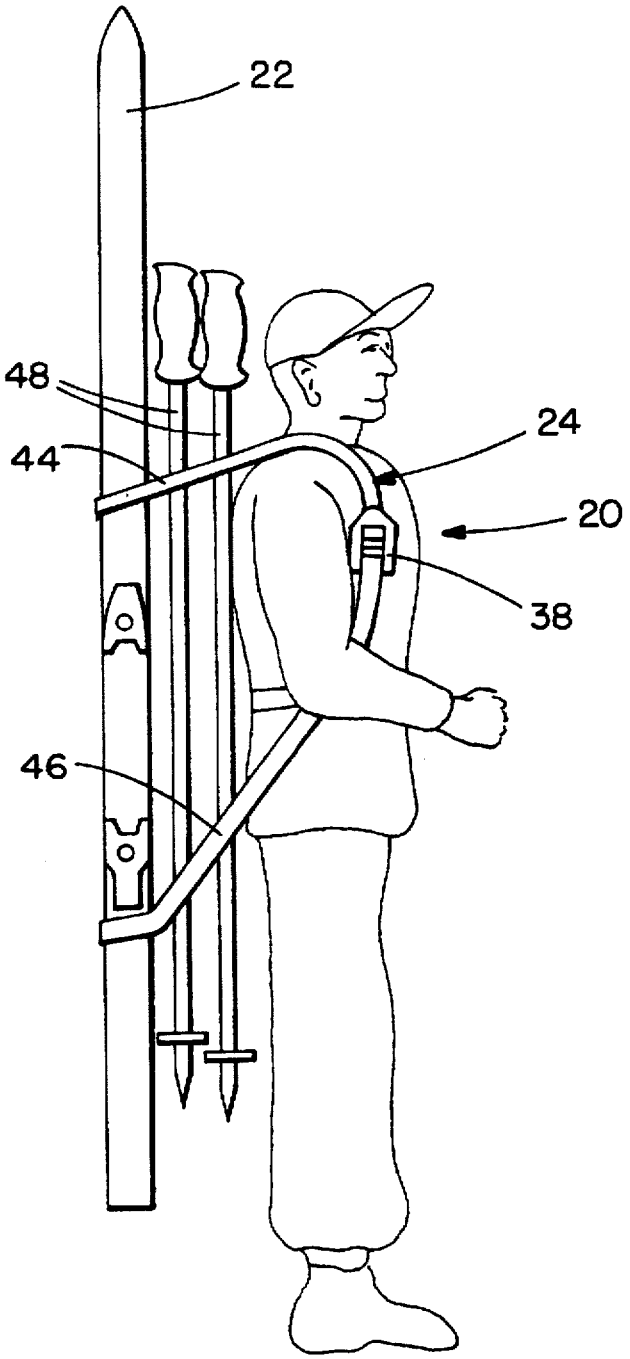
FIG. 10 is a side elevation view of a skier carrying his skis and ski poles over his shoulder in a vertical orientation using the carrying assembly of the invention.

A similar construction is provided for the second or aft strap member 46 and, indeed, the embodiment illustrated in FIGS. 9A and 9B is preferred. This is for the reason that both the ski loops 30, 34 and the pole loops 50, 52 tighten down in a snug relationship with the skis and with the poles, respectively. In fact, they tighten down to such an extent that a skier is able to carry the skis over his shoulder in a vertical orientation as seen in FIG. 10. From the standpoint of the skier, this is a most natural and comfortable manner for carrying the skis and ski poles.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A carrier assembly to be used by a skier for carrying a pair of skis and a pair of ski poles alternatively by hand or over the shoulder of the skier comprising:

elongated strap means extending between fore and aft ends, said strap means having a fore ski loop at said fore end being of a size to freely receive therethrough fore ends of a pair of skis in side-by-side relationship, said strap means having an aft ski loop at said aft end being of a size to freely receive therethrough aft ends of the pair of skis in side-by-side relationship;

buckle means intermediate said fore and aft ends of said strap means for adjustably interconnecting said fore and aft ends such that, in one instance, said strap means and the skis together define a transport loop of reduced size for the skier to carry the pair of skis by hand and, in another instance, said strap means and the skis together define a transport loop of enlarged size for the skier to carry the pair of skis over the shoulder of the skiers a fore pole loop adjacent said fore ski loop being initially of a size to freely receive therethrough fore ends of a pair of ski poles in side-by-side relationship;

an aft pole loop adjacent said aft ski loop being initially of a size to freely receive therethrough the aft ends of a pair of ski poles in side-by-side relationship;

said fore and aft ski loops being of a fixed size;

said fore and aft pole loops being size adjustable;

a fore ring member fixed to said strap means adjacent said fore ski loop;

an aft ring member fixed to said strap means adjacent said aft ski loop; and wherein said strap means includes a fore strap member extending away from said fore ski loop toward said buckle means, said fore strap member being threaded through said fore ring member to form said fore pole loop; and wherein said strap means includes an aft strap member extending away from said aft ski loop toward said buckle means, said aft strap member being threaded through said aft ring member to form said aft pole loop;

whereby drawing said fore strap member in a direction away from said fore ring member reduces the size of said fore pole loop until said fore pole loop snugly engages the pair of ski poles at their fore ends; and whereby drawing said aft strap member in a direction away from said aft ring member reduces the size of said aft pole loop until said aft pole loop snugly engages the pair of ski poles at their aft ends.

2. A carrier assembly as set forth in claim 1 wherein said fore strap member extends away from said fore ski loop at a location adjacent said fore ring member; and wherein said aft strap member extends away from said aft ski loop at a location adjacent said aft ring member.

3. A carrier assembly as set forth in claim 1 wherein said fore ring member includes:

an endless peripheral band and a cross member joined to said peripheral band at spaced locations to thereby define first and second side-by-side apertures therein; and wherein said aft ring member includes:

an endless peripheral band and a cross member joined to said peripheral band at spaced locations to thereby define first and second side-by-side apertures therein;

wherein said strap means includes a fore strap member extending away from said fore ski loop toward said buckle means, said fore strap member being threaded through the first and second apertures and around said cross member of said fore ring member to form said fore pole loop; and wherein said strap means includes an aft strap member extending away from said aft ski loop toward said buckle means, said aft strap member being threaded through the first and second apertures and around said cross member of said aft ring member to form said aft pole loop.

4. A carrier assembly to be used by a skier for carrying a pair of skis and a pair of ski poles alternatively by hand or over the shoulder of the skier comprising:

elongated strap means extending between fore and aft ends, said strap means having a fore ski loop at said fore end being initially of a size to freely receive therethrough fore ends of a pair of skis in side-by-side relationship, said strap means having an aft ski loop at said aft end being initially of a size to freely receive therethrough aft ends of the pair of skis in side-by-side relationship;

buckle means intermediate said fore and aft ends of said strap means for adjustably interconnecting said fore and aft ends such that, in one instance, said strap means and the skis together define a transport loop of reduced size for the skier to carry the pair of skis by hand and, in another instance, said strap means and the skis together define a transport loop of enlarged size for the skier to carry the pair of skis over the shoulder of the skier;

a fore pole loop adjacent said fore ski loop being initially of a size to freely receive therethrough fore ends of a pair of ski poles in side-by-side relationship;

an aft pole loop adjacent said aft ski loop being initially of a size to freely receive therethrough the aft ends of a pair of ski poles in side-by-side relationship;

said fore and aft ski loops being of a fixed maximum size when the strap material of which they are comprised is drawn taut;

a fore ring member fixed to said strap means adjacent said fore ski loop;

an aft ring member fixed to said strap means adjacent said aft ski loop; and wherein said strap means includes a fore strap member extending away from said fore ski loop toward said buckle means, said fore strap member being threaded through said fore ring member to form said fore pole loop; and wherein said strap means includes an aft strap member extending away from said aft ski loop toward said buckle means, said aft strap member being threaded through said aft ring member to form said aft pole loop;

whereby drawing said fore strap member in a direction away from said fore ring member reduces the size of said fore pole loop until said fore pole loop snugly engages the pair of ski poles at their fore ends; and whereby drawing said aft strap member in a direction away from said aft ring member reduces the size of said aft pole loop until said aft pole loop snugly engages the pair of ski poles at their aft ends.

5. A carrier assembly as set forth in claim 4 wherein said fore strap member extends away from said fore ski loop at a location adjacent said fore ring member; and wherein said aft strap member extends away from said aft ski loop at a location adjacent said aft ring member.

6. A carrier assembly as set forth in claim 4 wherein said fore strap member extends away from said fore ski loop at a location spaced from said fore ring member; and wherein said aft strap member extends away from said aft ski loop at a location spaced from said fore ring member;

whereby drawing said fore strap member in a direction away from said fore ring member reduces the size of said fore ski loop until said fore ski loop snugly engages the pair of skis at their fore ends; and whereby drawing said aft strap member in a direction away from said aft ring member reduces the size of said aft ski loop until said aft ski loop snugly engages the pair of skis at their aft ends.

* * * * *